US011624364B2

(12) United States Patent
Hattori et al.

(10) Patent No.: US 11,624,364 B2
(45) Date of Patent: Apr. 11, 2023

(54) ELECTRIC COMPRESSOR

(71) Applicant: KABUSHIKI KAISHA TOYOTA JIDOSHOKKI, Kariya (JP)

(72) Inventors: Yuya Hattori, Aichi-ken (JP); Takuro Yamashita, Aichi-ken (JP); Takumi Maeda, Aichi-ken (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 0 days.

(21) Appl. No.: 16/997,204

(22) Filed: Aug. 19, 2020

(65) Prior Publication Data

US 2021/0062808 A1 Mar. 4, 2021

(30) Foreign Application Priority Data

Aug. 30, 2019 (JP) ..... JP2019-157611

(51) Int. Cl.
*F04C 18/02* (2006.01)
*F04C 23/00* (2006.01)

(52) U.S. Cl.
CPC ..... *F04C 18/0215* (2013.01); *F04C 23/008* (2013.01); *F04C 2240/30* (2013.01); (Continued)

(58) Field of Classification Search
CPC ..... F04C 18/0215; F04C 2240/807; F04C 2240/40; F04C 2240/30; F04C 23/008; F04C 18/0207–0292
See application file for complete search history.

(56) References Cited

U.S. PATENT DOCUMENTS 6,247,907 B1 * 6/2001 Williams ..... F04C 23/008 417/368
6,454,551 B2 * 9/2002 Kuroki ..... F04C 27/005 418/188

(Continued)

FOREIGN PATENT DOCUMENTS

JP 02-091489 A 3/1990
JP 201252490 A 3/2012

(Continued)

OTHER PUBLICATIONS

Communication dated Oct. 6, 2021 from the Korean Intellectual Property Office in application No. 1020200105155.

*Primary Examiner* — Mark A Laurenzi
*Assistant Examiner* — Xiaoting Hu
(74) *Attorney, Agent, or Firm* — Sughrue Mion, PLLC

(57) ABSTRACT

An electric compressor includes a housing, a drive shaft, a motor, a fixed scroll, a movable scroll, and a fixed block. The fixed block is fixed to the housing and disposed between the motor and the movable scroll. The motor includes a stator and a rotor. The rotor has an introduction passage that is formed through the rotor in an axial direction of the drive shaft. The drive shaft includes a balance weight that is disposed between the fixed block and the motor. The balance weight extends to a position where the balance weight covers at least a part of the introduction passage in a radial direction of the drive shaft in a view in the axial direction of the drive shaft. The balance weight is located away from the rotor by a predetermined distance in the axial direction of the drive shaft.

2 Claims, 4 Drawing Sheets

(52) U.S. Cl.
CPC ..... *F04C 2240/40* (2013.01); *F04C 2240/60* (2013.01); *F04C 2240/807* (2013.01)

(56) References Cited

U.S. PATENT DOCUMENTS

| | | | | |
|---|---|---|---|---|
| 8,215,926 | B2 * | 7/2012 | Fields | F04B 39/066 417/368 |
| 2003/0219349 | A1 * | 11/2003 | Milliff | F04C 23/008 417/410.5 |
| 2014/0134014 | A1 * | 5/2014 | Mera | F04C 18/0207 417/371 |
| 2014/0255231 | A1 * | 9/2014 | Kii | F04C 18/0215 418/55.1 |
| 2015/0152864 | A1 * | 6/2015 | Nagaoka | F04C 23/008 417/410.5 |
| 2015/0184652 | A1 * | 7/2015 | Murakami | F04C 29/0085 418/55.3 |
| 2020/0212760 | A1 * | 7/2020 | Hattori | H02K 7/04 |

FOREIGN PATENT DOCUMENTS

| | | | | |
|---|---|---|---|---|
| KR | 20110128680 | A | * | 11/2011 |
| KR | 1020140063432 | A | | 5/2014 |

* cited by examiner

ELECTRIC COMPRESSOR

This application claims priority to Japanese Patent Application No. 2019-157611 filed on Aug. 30, 2019, the entire disclosure of which is incorporated herein by reference.

The present disclosure relates to an electric compressor.

BACKGROUND ART

Japanese Patent Application Publication No. 02-91489 discloses a known electric compressor (hereinafter simply referred to as a compressor). This compressor includes a housing, a drive shaft, a motor, a fixed scroll, a movable scroll, and a fixed block.

The drive shaft is disposed in the housing, and is rotatable around an axis of the drive shaft. The motor is disposed in the housing, and rotates the drive shaft. The fixed scroll is fixed to the housing, and is disposed in the housing. The movable scroll is disposed in the housing and connected to the drive shaft. The movable scroll is engaged with the fixed scroll, and a compression chamber is formed between the movable scroll and the fixed scroll. The fixed block is fixed to the housing and disposed between the movable scroll and the motor. The fixed block supports the drive shaft such that the drive shaft is rotatable, and defines, in the housing, a motor chamber for accommodating the motor.

Specifically, the housing has a union for suction. The fixed block has an annular passage and a communication passage. The annular passage extends annularly on an outer peripheral surface of the fixed block, and faces the union for suction. The communication passage is formed inside the fixed block and communicates with the annular passage and an inside of the motor chamber. The motor includes a stator and a rotor. The stator is fixed to the fixed block in the motor chamber. The rotor is fixed to the drive shaft and disposed in the stator such that the rotor is rotatable together with the drive shaft. In this compressor, an introduction passage is formed between an inside wall of the housing and the fixed block in the motor chamber. That is, the introduction passage is located on an outer peripheral side of the stator, and extends in an axial direction of the drive shaft.

Further in this compressor, a balance weight is disposed on the drive shaft. The balance weight is disposed between the movable scroll and the fixed block, that is, outside the motor chamber. The balance weight extends in a radial direction of the drive shaft and away from the axis of the drive shaft.

In this compressor, the motor rotates the drive shaft. Rotation of the drive shaft causes the movable scroll to revolve. Refrigerant is drawn from outside of the compressor into the motor chamber through the union for suction, the annular passage, and the communication passage. The refrigerant drawn into the motor chamber is then drawn into the compression chamber through the introduction passage and compressed in the compression chamber. In this compressor, the drive shaft receives centrifugal force that is generated by the balance weight due to the rotation of the drive shaft. This reduces runout of the drive shaft in a direction intersecting with the axis of the drive shaft while the compressor is in operation. Further, in this compressor, the refrigerant flowing through the introduction passage cools the stator.

The above-described known compressor needs to be compact so that the compressor can be mounted easily to a vehicle or the like. However, if the housing of the compressor therefore becomes compact, it is difficult for the compressor to secure a space for the introduction passage between the housing and the fixed block in the motor chamber. To solve this problem, the rotor may have the introduction passage. However, the rotor is disposed in the stator, so that it is unlikely that the refrigerant flowing through the introduction passage in the rotor can cool the stator suitably. Accordingly, the stator may generate heat, which may lead to a decrease in the durability of the compressor.

The present disclosure, which has been made in light of the above-mentioned problem, is directed to providing an electric compressor that is compact and has excellent durability.

SUMMARY

In accordance with one aspect of the present disclosure, there is provided an electric compressor that includes a housing, a drive shaft, a motor, a fixed scroll, a movable scroll, and a fixed block. The drive shaft is disposed in the housing and rotatable around an axis of the drive shaft. The motor is disposed in the housing and configured to rotate the drive shaft. The fixed scroll is fixed to and disposed in the housing. The movable scroll is disposed in the housing and connected to the drive shaft. The movable scroll is revolved by rotation of the drive shaft. The compression chamber that compresses refrigerant is formed between the movable scroll and the fixed scroll. The fixed block is fixed to the housing and disposed between the motor and the movable scroll. The fixed block supports the drive shaft such that the drive shaft is rotatable. The fixed block defines a motor chamber in the housing to accommodate the motor. The housing has an inlet through which refrigerant is drawn into the motor chamber. The motor includes a stator that is fixed in the motor chamber and a rotor that is fixed to the drive shaft, disposed in the stator, and rotatable together with the drive shaft. The rotor has an introduction passage that is formed through the rotor in an axial direction of the drive shaft. Refrigerant flows through the introduction passage. The drive shaft includes a balance weight that is disposed between the fixed block and the motor. The balance weight extends to a position where the balance weight covers at least a part of the introduction passage in a radial direction of the drive shaft in a view in the axial direction of the drive shaft. The balance weight is located away from the rotor by a predetermined distance in the axial direction of the drive shaft.

Other aspects and advantages of the present disclosure will become apparent from the following description, taken in conjunction with the accompanying drawings, illustrating by way of example the principles of the present disclosure.

BRIEF DESCRIPTION OF THE DRAWINGS

The present disclosure together with objects and advantages thereof, may best be understood by reference to the following description of the presently preferred embodiments together with the accompanying drawings in which.

DETAILED DESCRIPTION OF THE EMBODIMENTS

The following will describe an embodiment of the present disclosure in detail with reference to the accompanying drawings. A compressor according to the embodiment is, specifically, an electric scroll compressor. This scroll compressor is mounted in a vehicle (not illustrated) and included in a refrigerant circuit of the vehicle.

Figure 1:
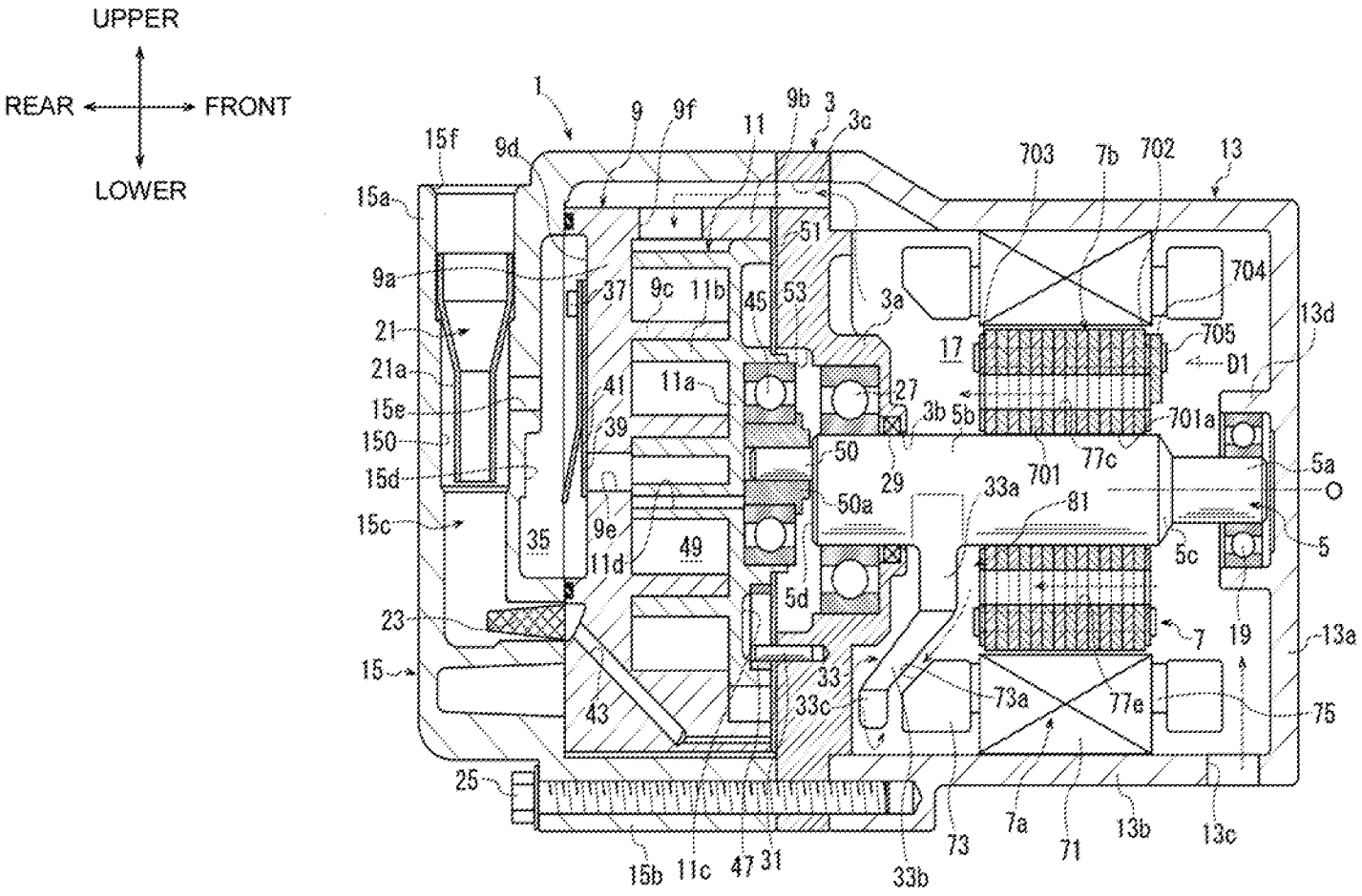
FIG. 1 is a sectional view of a compressor according to an embodiment.

As illustrated in FIG. 1, the compressor according to the embodiment includes a housing 1, a fixed block 3, a drive shaft 5, a motor 7, a fixed scroll 9, and a movable scroll 11. The housing 1 includes a motor housing 13 and a compressor housing 15. FIG. 1 illustrates the drive shaft 5, the motor 7, and the like in a simplified shape for the sake of explanation. The same is true in FIG. 3 that will be described later.

Figure 2:
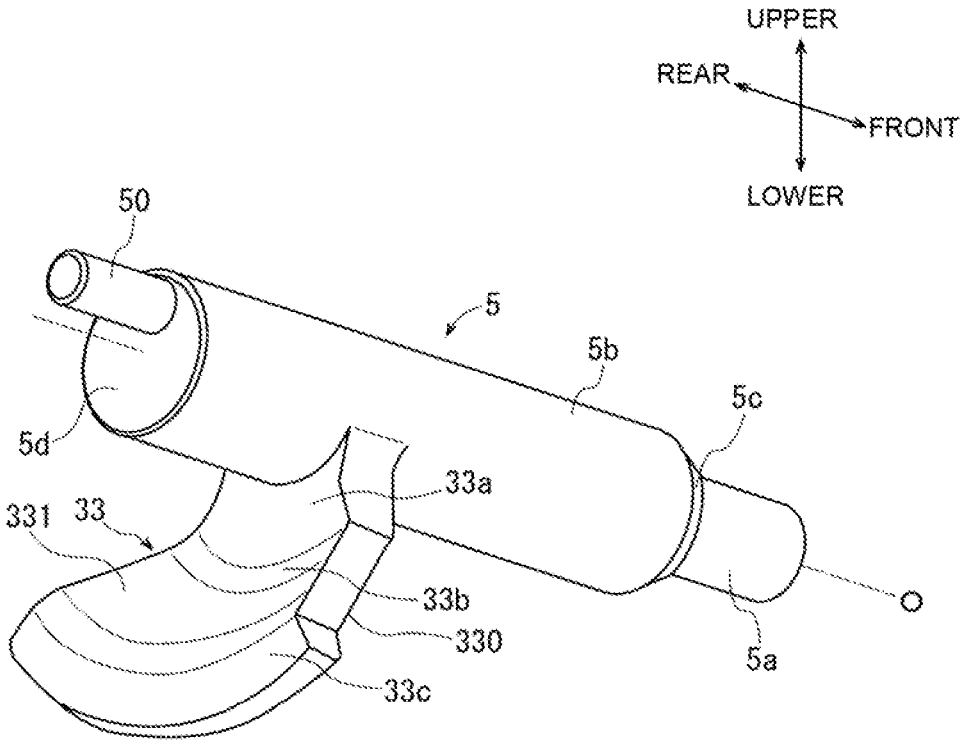
FIG. 2 is a perspective view of a drive shaft and a balance weight of the compressor according to the embodiment.

As illustrated in FIG. 1, in the present embodiment, the front-rear direction of the compressor is defined by referring to the side on which the motor housing 13 is positioned as the front side of the compressor and referring to the side on which the compressor housing 15 is positioned as the rear side of the compressor. Further, the up-down direction of the compressor is defined by referring to the top of FIG. 1 as the upper side of the compressor and referring to the bottom of FIG. 1 as the lower side of the compressor. In FIG. 2 and thereafter, the front-rear direction and the up-down direction are indicated so as to correspond to those in FIG. 1. The front-rear direction and the like in the embodiment are merely examples, and the compressor of the present disclosure may be mounted appropriately in various postures depending on the vehicle on which the compressor is mounted.

The motor housing 13 includes a front wall 13*a* and a first peripheral wall 13*b*. The front wall 13*a* is located at a front end of the motor housing 13, i.e., at a front end of the housing 1, and extends in a radial direction of the motor housing 13. The first peripheral wall 13*b* is connected to the front wall 13*a*, and extends rearward from the front wall 13*a* in a direction of an axis O of the drive shaft 5 (i.e., an axial direction of the drive shaft 5). The front wall 13*a* and the first peripheral wall 13*b* cooperate to form the bottomed-cylindrical motor housing 13. Further, the front wall 13*a* and the first peripheral wall 13*b* cooperate to define a motor chamber 17 in the motor housing 13. The axis O is parallel to the front-rear direction of the compressor.

The motor housing 13 has an inlet 13*c* and a support part 13*d*. The inlet 13*c* is formed in a front portion of the first peripheral wall 13*b*, and communicates with the inside of the motor housing 13, i.e., the motor chamber 17, which will be described later. The inlet 13*c* is connected to an evaporator (not illustrated) via piping (not illustrated). The support part 13*d* projects from the front wall 13*a* into the motor housing 13. The support part 13*d* has a cylindrical shape, and a first radial bearing 19 is disposed in the support part 13*d*. The inlet 13*c* may be formed in the front wall 13*a*.

The compressor housing 15 includes a rear wall 15*a* and a second peripheral wall 15*b*. The rear wall 15*a* is located at a rear end of the compressor housing 15, i.e., at a rear end of the housing 1, and extends in a radial direction of the compressor housing 15. The second peripheral wall 15*b* is connected to the rear wall 15*a* and extends frontward from the rear wall 15*a* in the direction of the axis O. The rear wall 15*a* and the second peripheral wall 15*b* cooperate to form the bottomed-cylindrical compressor housing 15.

The compressor housing 15 has an oil separating chamber 15*c*, a first recess 15*d*, a discharge passage 15*e*, and an outlet 15*f*. The oil separating chamber 15*c* is located on a rear side in the compressor housing 15, and extends in the radial direction of the compressor housing 15. The first recess 15*d* is formed within the compressor housing 15 and in front of the oil separating chamber 15*c*, and is depressed toward the oil separating chamber 15*c*. The discharge passage 15*e* is formed within the compressor housing 15 and extends in the direction of the axis O to be connected to the oil separating chamber 15*c* and the first recess 15*d*. The outlet 15*f* communicates with a top end of the oil separating chamber 15*c* and is opened to the outside of the compressor housing 15. The outlet 15*f* is connected to a condenser (not illustrated) via piping (not illustrated).

The oil separating chamber 15*c* is fixed to an oil separating cylinder 21. The oil separating cylinder 21 has an outer peripheral surface 21*a* that forms a cylindrical shape. The outer peripheral surface 21*a* is coaxial with an inner peripheral surface 150 of the oil separating chamber 15*c*. The outer peripheral surface 21*a* and the inner peripheral surface 150 cooperate to form a separator. A filter 23 is disposed below the oil separating cylinder 21 in the oil separating chamber 15*c*.

Figure 3:
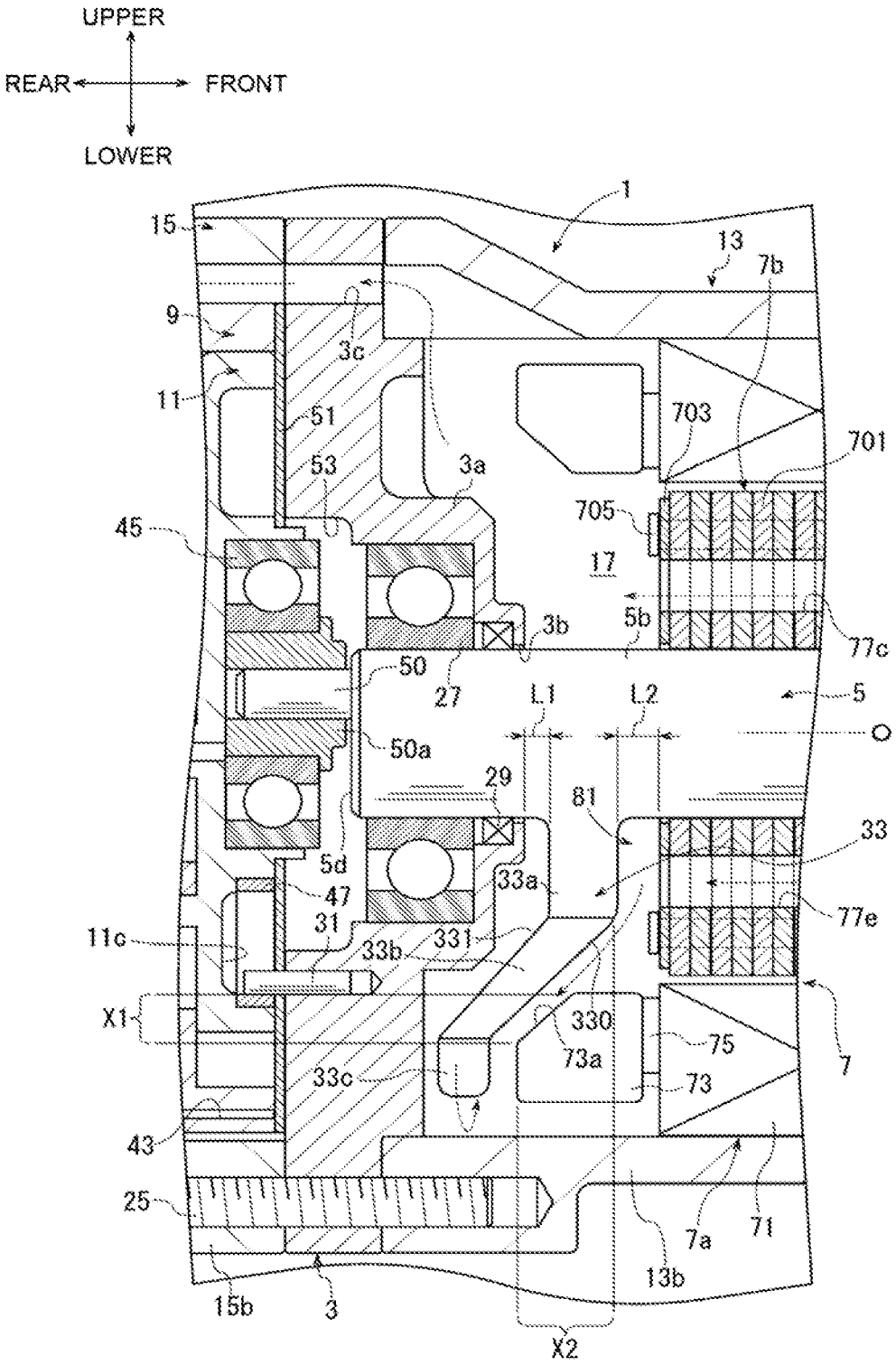
FIG. 3 is an enlarged sectional view of the compressor according to the embodiment, illustrating a main part of the compressor, such as the balance weight and a stator.

The fixed block 3 is disposed between the motor housing 13 and the compressor housing 15. The motor housing 13, the compressor housing 15, and the fixed block 3 are tightened with a plurality of bolts 25 from the compressor housing 15 side. In this way, the fixed block 3 is held between the motor housing 13 and the compressor housing 15, and fixed to the motor housing 13 and the compressor housing 15, i.e., the housing 1. Accordingly, the fixed block 3 is fixed to the housing 1 and disposed between the motor 7 and the movable scroll 11 in the housing 1. FIGS. 1 and 3 illustrate only one of the bolts 25. A method for fixing the fixed block 3 to the housing 1 is determined as necessary.

Since the fixed block 3 is fixed to the housing 1, the fixed block 3 cooperates with the front wall 13*a* and the first peripheral wall 13*b* of the motor housing 13 to define the motor chamber 17 in the housing 1. That is, the motor chamber 17 is located within the motor housing 13 and communicates with the inlet 13*c*. The refrigerant is drawn from the evaporator into the motor chamber 17 through the inlet 13*c*. In this compressor, the motor chamber 17 also serves as a suction chamber.

The fixed block 3 includes a boss 3*a* that projects into the motor chamber 17 and therefore toward the motor 7. The boss 3*a* has an insertion hole 3*b* at a top end of the boss 3*a*. A second radial bearing 27 and a sealing member 29 are disposed in the boss 3*a*. The boss 3*a* has an outer diameter that is smaller than an inner diameter of a plurality of coil ends 73, which will be described later. A plurality of anti-rotation pins 31 is fixed to a rear side of the fixed block 3. The anti-rotation pins 31 extend rearward from the fixed block 3. FIGS. 1 and 3 illustrate only one of the anti-rotation pins 31.

The fixed block 3 further has a suction passage 3*c*. The suction passage 3*c* is formed through the fixed block 3 in the front-rear direction, i.e., in the direction of the axis O. The suction passage 3*c* allows the motor chamber 17 to communicate with the inside of the compressor housing 15 through the suction passage 3*c*. The suction passage 3*c* is formed in the fixed block 3 at a position outward of the motor 7, specifically, located outward of a stator 7*a*, i.e., outward of the balance weight 33, in the radial direction of the drive shaft 5.

As illustrated in FIG. 2, the drive shaft 5 has a cylindrical shape and extends in the direction of the axis O. The drive shaft 5 includes a small-diameter portion 5*a*, a large-diameter portion 5*b*, and a taper portion 5*c*. The small-diameter portion 5*a* forms a frond end portion of the drive shaft 5. The large-diameter portion 5*b* is located behind the small-diameter portion 5*a*. The large-diameter portion 5*b* has a diameter greater than that of the small-diameter portion 5*a*. The large-diameter portion 5*b* has a flat rear end face 5*d* at a rear end of the large-diameter portion 5*b*. The taper portion 5*c* is located between the small-diameter portion 5*a* and the large-diameter portion 5*b*. The taper portion 5*c* is connected to the small-diameter portion 5*a* at a front end of the taper portion 5*c*. The taper portion 5*c* increases its diameter as the taper portion 5*c* extends rearward, and is connected to the large-diameter portion 5*b* at a rear end of the taper portion 5*c*.

Further, an eccentric pin 50 is fixed to the large-diameter portion 5*b*. The eccentric pin 50 is located on the rear end face 5*d* at a position eccentric from the axis O. The eccentric pin 50 has a cylindrical shape and a diameter smaller than that of the drive shaft 5, and extends rearward from the rear end face 5*d*.

As illustrated in FIG. 1, the drive shaft 5 is disposed in the housing 1. The small-diameter portion 5*a* of the drive shaft 5 is rotatably supported by the support part 13*d* of the motor housing 13 via the first radial bearing 19. The rear end of the large-diameter portion 5*b* and the eccentric pin 50 are inserted into the boss 3*a* through the insertion hole 3*b* of the fixed block 3. The rear end of the large-diameter portion 5*b* is rotatably supported by the second radial bearing 27 in the boss 3*a*. The drive shaft 5 is supported by the fixed block 3 such that the drive shaft 5 is rotatable around the axis O in the housing 1. The sealing member 29 seals a gap between the fixed block 3 and the drive shaft 5. The eccentric pin 50 is fitted in a bushing 50*s* in the boss 3*a*.

As illustrated in FIG. 2, the drive shaft 5 includes the balance weight 33 formed integrally with the large-diameter portion 5*b* of the drive shaft 5. The balance weight 33 is located at a position eccentric from the axis O in the large-diameter portion 5*b*. Specifically, the balance weight 33 is located on a side opposite to the eccentric pin 50 with respect to the axis O.

The balance weight 33 has a plate-like and fan-like shape. The balance weight 33 extends away from the large-diameter portion 5*b* in the radial direction of the drive shaft 5, that is, extends from the large-diameter portion 5*b* toward the first peripheral wall 13*b* of the motor housing 13. As illustrated in FIG. 3, the balance weight 33 has a proximal portion 33*a*, a middle portion 33*b*, and a distal portion 33*c*. The proximal portion 33*a* is connected to the large-diameter portion 5*b*, and substantially vertically extends from the large-diameter portion 5*b* in the radial direction of the drive shaft 5. The middle portion 33*b* is connected to the proximal portion 33*a*. The middle portion 33*b* is gradually inclined rearward while extending from the proximal portion 33*a* in the radial direction of the drive shaft 5. The middle portion 33*b* has a front surface 330 and a rear surface 331 respectively on opposite sides of the middle portion 33*b*. The front surface 330 serves as an inclined surface of the present disclosure, for example. As in the shape of the middle portion 33*b*, the front surface 330 and the rear surface 331 are gradually inclined rearward while extending in the radial direction of the drive shaft 5. The distal portion 33*c* is connected to the middle portion 33*b*, and substantially vertically extends from the middle portion 33*b* in the radial direction of the drive shaft 5.

The drive shaft 5 is disposed in the housing 1, so that the balance weight 33 is located in the motor chamber 17. That is, the balance weight 33 is disposed in the motor chamber 17 and between the fixed block 3 and the motor 7. The balance weight 33 is located away from the boss 3*a* of the fixed block 3 by a distance L1. Accordingly, the balance weight 33 is not in contact with the boss 3*a* in the motor chamber 17.

As illustrated in FIG. 1, the motor 7 is accommodated in the motor chamber 17 (disposed in the housing 1), and located in front of the balance weight 33. The motor 7 is configured to rotate the drive shaft 5. The motor 7 includes the stator 7*a* and a rotor 7*b*. The stator 7*a* is disposed radially outward of the rotor 7*b*, that is, located between the rotor 7*b* and an inner peripheral surface of the first peripheral wall 13*b*. The stator 7*a* is fixed to the inner peripheral surface of the first peripheral wall 13*b*. Accordingly, the stator 7*a* is fixed in the motor chamber 17. The motor 7 is connected, via the stator 7*a*, to an inverter (not illustrated) that is disposed outside the motor housing 13.

The stator 7*a* includes a stator core 71 and a coil 75 having the coil ends 73. In other words, the stator 7*a* includes the coil ends 73. The stator core 71 has a cylindrical shape. The stator core 71 is wrapped in the coil 75. The coil ends 73 protrude from end faces of the stator core 71, i.e., a front end face and a rear end face of the stator core 71, in an axial direction of the stator core 71, and the coil ends 73 each have a ring shape. The coil ends 73 form a part of the coil 75. The outer diameter of the boss 3*a* is smaller than the inner diameter of each coil end 73, so that the rear coil end 73 covers the distal end of the boss 3*a* in the direction of the axis O of the drive shaft 5, i.e., an axial direction of the drive shaft 5, in the motor chamber 17.

As illustrated in FIG. 3, the coil end 73 has an inner peripheral surface 73*a* that faces the drive shaft 5. A rear part of the inner peripheral surface 73*a*, that is, the inner peripheral surface 73*a* of the rear coil end 73 on the fixed block 3 side, extends in a radial direction of the drive shaft 5 as the inner peripheral surface 73*a* approaches the fixed block 3. Specifically, the rear part of the inner peripheral surface 73*a* is inclined along the middle portion 33*b* of the balance weight 33 and away from the front surface 330 of the middle portion 33*b* and therefore the balance weight 33. Such a shape of the inner peripheral surface 73*a* prevents an interference between the middle portion 33*b* and the inner peripheral surface 73*a*, thus, an interference between the balance weight 33 and the coil end 73, in the motor chamber 17.

In this compressor, the balance weight 33 extends, in the radial direction of the drive shaft 5, from the drive shaft 5 toward the rear coil end 73 of the stator 7*a* beyond the rotor 7*b*, in the motor chamber 17. Accordingly, the middle portion 33*b* and the distal portion 33*c* of the balance weight 33 cooperate to cover a part of the rear coil end 73 in the radial direction and the axial direction of the drive shaft 5 in a view in the axial direction of the drive shaft 5. Specifically, the middle portion 33*b* covers the rear part of the inner peripheral surface 73*a* of the rear coil end 73 in the radial direction of the drive shaft 5 in a first region X1 and in the axial direction of the drive shaft 5 in a second region X2.

As illustrated in FIG. 1, the rotor 7*b* is disposed in the stator 7*a*. The rotor 7*b* includes a rotor body 701, a first retaining plate 702, a second retaining plate 703, a rotor weight 704, a plurality of coupling pins 705, and a plurality of magnet cores (not illustrated).

The rotor body 701 is made from approximately-ring-shaped steel sheets laminated on top of each other in the direction of the axis O. The rotor body 701, i.e., steel sheets, has a shaft hole 701*a* through which the drive shaft 5 is inserted. Accordingly, the rotor body 701 has an approximately cylindrical shape and extends in the direction of the axis O. The magnet cores are disposed in the rotor body 701.

Figure 4:
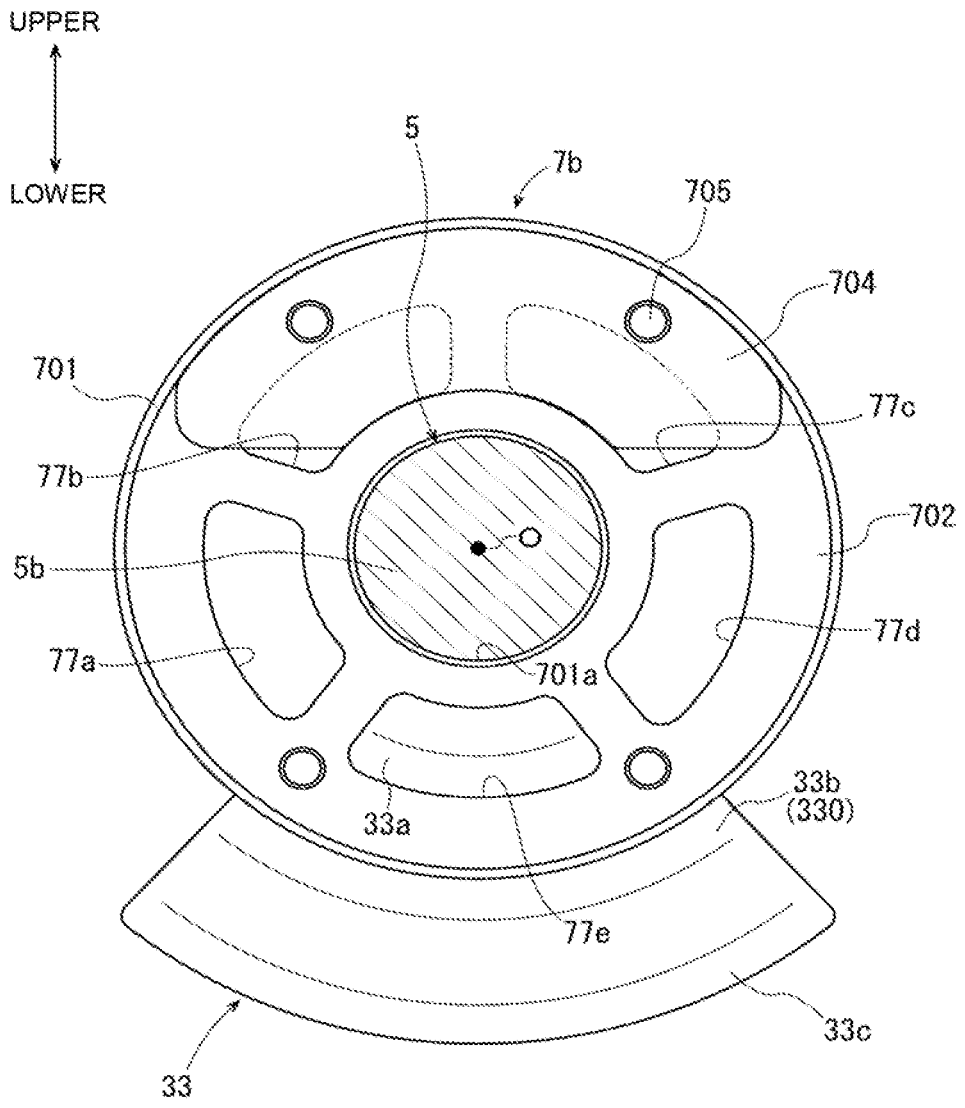
FIG. 4 is a front view of a rotor, the drive shaft, and the balance weight of the compressor according to the embodiment when viewed in a direction D1 in FIG. 1.

The first retaining plate 702 and the second retaining plate 703 each have a disc shape and are made from a metal plate. The first retaining plate 702 is located on a front portion of the rotor body 701. The second retaining plate 703 is located on a rear portion of the rotor body 701. As illustrated in FIG. 4, the rotor weight 704 has an approximately semi-circular shape and is made from a metal plate. As illustrated in FIG. 1, the rotor weight 704 has a thickness greater than that of the first retaining plate 702 and that of the second retaining plate 703. The shape and the thickness of the rotor weight 704 may be determined as necessary.

The rotor weight 704, the first retaining plate 702, the rotor body 701, and the second retaining plate 703 are arranged in this order from the front side in the direction of the axis O to form the rotor 7*b*. The coupling pins 705 are inserted through the rotor weight 704, the first retaining plate 702, the rotor body 701, and the second retaining plate 703. Each of the coupling pins 705 is swaged at a front end and a rear end of the coupling pin 705, so that the rotor body 701 is fixed to the first retaining plate 702 and the second retaining plate 703 and held between the first retaining plate 702 and the second retaining plate 703. The rotor weight 704 is fixed to a front surface of the first retaining plate 702. A method for fixing the rotor body 701, the first retaining plate 702, the second retaining plate 703, and the rotor weight 704 with the coupling pins 705 is determined as necessary.

The rotor 7*b* has first to fifth introduction passages 77*a*-77*e*. The first to fifth introduction passages 77*a*-77*e* each serve as an introduction passage of the present disclosure. The first to fifth introduction passages 77*a*-77*e* extend from the first retaining plate 702 to the second retaining plate 703 through the rotor body 701, that is, from the inlet 13*c* side to the fixed block 3 side, in the direction of the axis O. That is, the first to fifth introduction passages 77*a*-77*e* are formed through the rotor 7*b* in the direction of the axis O, i.e., the axial direction of the drive shaft 5. The first to fifth introduction passages 77*a*-77*e* have the same fan-like shape. The shape and quantity of the first to fifth introduction passages 77*a*-77*e* are determined as necessary.

The first to fifth introduction passages 77*a*-77*e* are arranged equiangularly in a circumferential direction of the rotor 7*b*. The rotor weight 704 is fixed to the front surface of the first retaining plate 702, so that the second introduction passage 77*b* and the third introduction passage 77*c* among the first to fifth introduction passages 77*a*-77*e* face the rotor weight 704. Accordingly, front ends of the second introduction passage 77*b* and the third introduction passage 77*c* are mostly covered by the rotor weight 704, although not completely closed. In contrast, the first introduction passage 77*a*, the fourth introduction passage 77*d*, and the fifth introduction passage 77*e* are shifted relative to the rotor weight 704 in the circumferential direction of the rotor 7*b*.

In this compressor, the large-diameter portion 5*b* of the drive shaft 5 is fitted in the shaft hole 701*a* of the rotor body 701 by shrink-fitting, so that the rotor 7*b* is fixed to the drive shaft 5. The position of the rotor 7*b* is determined relative to the drive shaft 5 such that the rotor weight 704 is positioned on the side opposite to the balance weight 33 with respect to the axis O. The rotor 7*b* may be fixed to the drive shaft 5 by means, such as key joint.

The rotor 7*b* rotates in the stator 7*a*, so that the drive shaft 5 rotates together with the rotor 7*b* around the axis O in the motor chamber 17 since the rotor 7*b* is fixed to the drive shaft 5 in this compressor.

Further, fixing the rotor 7*b* to the drive shaft 5 causes the balance weight 33 to be positioned behind the rotor 7*b*. As illustrated in FIG. 3, the rotor 7*b* is fixed to the drive shaft 5 with a space 81 formed between the balance weight 33 and the rotor 7*b*. The presence of the space 81 causes the balance weight 33, specifically, the proximal portion 33*a*, to be rearward away from the rotor 7*b* in the axial direction of the drive shaft 5 by a distance L2. That is, the balance weight 33 is located away from the rotor 7*b* by a predetermined distance. Accordingly, the balance weight 33 is not in contact with the rotor 7*b*. The distance L2 is longer than the distance L1 between the boss 3*a* of the fixed block 3 and the balance weight 33. The middle portion 33*b* of the balance weight 33 is gradually inclined rearward as the middle portion 33*b* extends in the radial direction of the drive shaft 5, so that the middle portion 33*b* and the distal portion 33*c* are more rearward away from the rotor 7*b* by a distance longer than the distance L2. When the rotor 7*b* is fixed to the drive shaft 5, the length of the distance L2, i.e., the size of the space 81 may be determined as necessary as long as the balance weight 33 is not in contact with the rotor 7*b*.

As illustrated in FIG. 4, in this compressor, the balance weight 33 is disposed between the first introduction passage 77*a* and the fourth introduction passage 77*d* when the rotor 7*b* is fixed to the drive shaft 5. The drive shaft 5 rotates together with the rotor 7*b* around the axis O as described above. Accordingly, the first to fourth introduction passages 77*a*-77*d* are located constantly outward of the balance weight 33 in the circumferential direction of the rotor 7*b* and the drive shaft 5, i.e., the rotation direction of the rotor 7*b* and the drive shaft 5. The balance weight 33, specifically, the proximal portion 33*a* of the balance weight 33, constantly faces the fifth introduction passage 77*e* in the axial direction of the drive shaft 5. Since the space 81 is formed between the balance weight 33 and the rotor 7*b*, the balance weight 33 is located away from the first to fifth introduction passages 77*a*-77*e* by the distance L2 in the axial direction of the drive shaft 5.

As illustrated in FIG. 1, the fixed scroll 9 is fixed to the compressor housing and accommodated in the compressor housing 15. The fixed scroll 9 includes a fixed base plate 9*a*, a fixed peripheral wall 9*b*, and a fixed scroll wall 9*c*. The fixed base plate 9*a* is located at a rear end of the fixed scroll 9 and has a disc shape. The fixed base plate 9*a* has a second recess 9*d* and a discharge port 9*e*. The second recess 9*d* is formed in a rear surface of the fixed base plate 9*a* and depressed frontward. The second recess 9*d* faces the first recess 15*d* since the fixed scroll 9 is fixed to the compressor housing 15. The first recess 15*d* and the second recess 9*d* cooperate to form the discharge chamber 35. The discharge chamber 35 communicates with the oil separating chamber 15*c* through the discharge passage 15*e*. The discharge port 9*e* extends through the fixed base plate 9*a* in the direction of the axis O to communicate with the second recess 9*d* and therefore the discharge chamber 35.

A discharge reed valve 39 and a retainer 41 are attached to the fixed base plate 9*a* with a pin 37. The pin 37, the discharge reed valve 39, and the retainer 41 are disposed in the discharge chamber 35. The discharge reed valve 39 elastically deforms to open and close the discharge port 9*e*. The retainer 41 regulates the deformation amount of the discharge reed valve 39.

The fixed peripheral wall 9*b* is connected to the outer periphery of the fixed base plate 9*a* and cylindrically extends frontward. The fixed peripheral wall 9*b* has a communication hole 9*f*. The communication hole 9*f* is formed through the fixed peripheral wall 9*b* in a radial direction of the fixed scroll 9, and is opened to the compressor housing 15. The fixed scroll wall 9*c* extends from a front surface of the fixed base plate 9*a*. The fixed scroll wall 9*c* is arranged radially inward of the fixed peripheral wall 9*b* and formed integrally with the fixed peripheral wall 9*b*.

The fixed scroll 9 has an oil supply passage 43. The oil supply passage 43 penetrates the fixed base plate 9*a* and the fixed peripheral wall 9*b*. The oil supply passage 43 opens on the rear surface of the fixed base plate 9*a* and a front end surface of the fixed peripheral wall 9*b* respectively at a rear end and a front end of the oil supply passage 43. The oil supply passage 43 communicates with the oil separating chamber 15*c* through a filter 23. The shape of the oil supply passage 43 may be determined as necessary.

The movable scroll 11 is disposed in the compressor housing 15 and is located between the fixed scroll 9 and the fixed block 3. The movable scroll 11 includes a movable base plate 11*a* and a movable scroll wall 11*b*. The movable base plate 11*a* is located at a front end of the movable scroll 11 and has a disc shape. The movable base plate 11*a* supports the bushing 50*a* via a third radial bearing 45 such that the bushing 50*a* is rotatable. Accordingly, the movable scroll 11 is connected to the drive shaft 5 via the bushing 50*a* and the eccentric pin 50 at a position eccentric from the axis O.

The movable base plate 11*a* has anti-rotation holes 11*c* in which distal ends of the anti-rotation pins 31 are loosely fitted. Rings 47 each having a cylindrical shape are loosely fitted in the anti-rotation holes 11*c*.

The movable scroll wall 11*b* extends from a front surface of the movable base plate 11*a* toward the fixed base plate 9*a*. The movable scroll wall 11*b* has, in a vicinity of the center of the movable scroll wall 11*b*, a supply hole 11*d* that is opened at a front end of the movable scroll wall 11*b* and extends in the front-rear direction to penetrate the movable scroll wall 11*b* and the movable base plate 11*a*.

The fixed scroll 9 and the movable scroll 11 mesh with each other. Accordingly, a compression chamber 49 is formed between the fixed scroll 9 and the movable scroll 11 and defined by the fixed base plate 9*a*, the fixed scroll wall 9*c*, the movable base plate 11*a*, and the movable scroll wall 11*b*. The compression chamber 49 is configured to communicate with the inside of the compressor housing 15 and therefore the suction passage 3*c* through the communication hole 9*f* of the fixed peripheral wall 9*b*. The compression chamber 49 communicates with the discharge port 9*e*.

An elastic plate 51 is disposed between the fixed block 3 and the fixed scroll 9 and the movable scroll 11. The fixed scroll 9 and the movable scroll 11 are in contact with the fixed block 3 via the elastic plate 51. The elastic plate 51 is made from a thin metal sheet. The movable scroll 11 is urged toward the fixed scroll 9 by the elastic restoring force of the elastic plate 51.

The movable base plate 11*a* and the elastic plate 51 cooperate to form a back-pressure chamber 53 in the boss 3*a* of the fixed block 3. The back-pressure chamber 53 communicates with the supply hole 11*d*.

In the compressor having such a configuration, refrigerant at low temperature and low pressure is drawn from the evaporator into a front region in the motor chamber 17 through the inlet 13*c* as indicated by dashed arrows in FIGS. 1 and 3. The refrigerant then reaches a rear region in the motor chamber 17, that is, a region in the motor chamber 17 on the fixed block 3 side through the first to fifth introduction passages 77*a*-77*e* of the rotor 7*b*, and further flows through the suction passage 3*c* of the fixed block 3 from the motor chamber 17. The motor 7 operates while being controlled by the inverter, so that the rotor 7*b* rotates around the axis O. Accordingly, the drive shaft 5 rotates around the axis O, and the rotation of the drive shaft 5 revolves the movable scroll 11. This allows the movable base plate 11*a* to slide on a distal end of the fixed scroll wall 9*c*, and the fixed scroll wall 9*c* and the movable scroll wall 11*b* to slide on each other. At this time, each anti-rotation pin 31 rotates in the ring 47 and slides on an inner peripheral surface of the ring 47, which allows orbital motion of the movable scroll 11 while restraining rotation motion of the movable scroll 11. The orbital motion of the movable scroll 11 allows the refrigerant to flow from the suction passage 3*c* into the compressor housing 15 and further flow into the compression chamber 49 through the communication hole 9*f*. Accordingly, the orbital motion of the movable scroll 11 decreases the volume of the compression chamber 49, and the compression chamber 49 therefore compresses the refrigerant therein.

In this compressor, the orbital motion of the movable scroll 11 causes the supply hole 11*d* to slightly open to the compression chamber 49. The refrigerant at high pressure in the compression chamber 49 partly flows into the back-pressure chamber 53 through the supply hole 11*d*, so that a pressure in the back-pressure chamber 53 becomes high. Accordingly, in this compressor, the movable scroll 11 is urged toward the fixed scroll 9 by the elastic plate 51 and the pressure in the back-pressure chamber 53 and seals the compression chamber 49 suitably.

The refrigerant highly compressed in the compression chamber 49 is discharged from the discharge port 9*e* into the discharge chamber 35, and flows from the discharge chamber 35 to the oil separating chamber 15*c* through the discharge passage 15*e*. The highly-compressed refrigerant is separated from lubricant oil while the refrigerant spirals between the outer peripheral surface 21*a* of the oil separating cylinder 21 and the inner peripheral surface 150 of the oil separating chamber 15*c*, and the refrigerant separated from the lubricant oil flows through the inside of the oil separating cylinder 21 and is discharged from the outlet 15*f*.

In contrast, the lubricant oil separated from the refrigerant is retained in the oil separating chamber 15*c*. The lubricant oil flows through the oil supply passage 43 via the filter 23, and is supplied to a sliding point between the fixed scroll 9 and the movable scroll 11 for lubricating the sliding point. The lubricant oil is also supplied between the second radial bearing 27 and the drive shaft 5, and supplied into the motor chamber 17, through the oil supply passage 43.

In this compressor, the movable scroll 11 is connected to the drive shaft 5 via the eccentric pin 50 and the bushing 50*a*. While the compressor is in operation, the drive shaft 5 receives centrifugal force generated by the orbital motion of the movable scroll 11. The drive shaft 5 with the balance weight 33 also receives centrifugal force generated by the balance weight 33 while the compressor is in operation. The drive shaft 5 is fixed to the rotor 7*b*, and the rotor 7*b* includes the rotor weight 704. This configuration causes the drive shaft 5 to further receive centrifugal force generated by the rotor weight 704 via the rotor 7*b* while the compressor is in operation. In this way, in this compressor, the centrifugal force by the balance weight 33 and the centrifugal force by the rotor weight 704 cooperate to appropriately cancel the centrifugal force applied by the movable scroll 11 to the drive shaft 5. Therefore, this compressor is capable of reducing runout of the drive shaft 5 in the radial direction of the drive shaft 5 while the compressor is in operation.

Further, in this compressor, the first to fifth introduction passages 77*a*-77*e* are formed in the rotor 7*b*, which eliminates the need for a space for the first to fifth introduction passages 77*a*-77*e* outward of the stator 7*a* in the motor chamber 17. This configuration of the compressor therefore allows the motor housing 13 to be compact.

Further, in this compressor, the balance weight 33 is disposed between the fixed block 3 and the rotor 7*b* (motor 7) in the motor chamber 17. Among the first to fifth introduction passages 77*a*-77*e* formed in the rotor 7*b*, the first to fourth introduction passages 77*a*-77*d* are constantly located outward of the balance weight 33 in the rotation direction of the rotor 7*b* and the drive shaft 5. Accordingly, the balance weight 33 does not prevent the flow of the refrigerant in the first to fourth introduction passages 77*a*-77*d*, so that the refrigerant suitably flows through the first to fourth introduction passages 77*a*-77*d*. In contrast, the fifth introduction passage 77*e* constantly faces the balance weight 33 in the axial direction of the drive shaft 5. The presence of the space 81 between the balance weight 33 and the rotor 7*b* in this compressor allows the rotor 7*b*, i.e., the fifth introduction passage 77*e*, to be located away from the proximal portion 33*a* of the balance weight 33 by the distance L2. Accordingly, although the proximal portion 33*a* and the fifth introduction passage 77*e* face each other in the axial direction of the drive shaft 5, the proximal portion 33*a* is unlikely to prevent the flow of the refrigerant the fifth introduction passage 77*e*. Therefore, the refrigerant suitably flows through the fifth introduction passage 77*e*, as in the first to fourth introduction passages 77*a*-77*d*.

After flowing through the first to fifth introduction passages 77*a*-77*e*, the refrigerant is stirred and guided by the balance weight 33 rotating together with the drive shaft 5, to the outer region in the motor chamber 17, i.e., a region on the stator 7*a* side, in the radial direction of the drive shaft 5, while flowing in the motor chamber 17 toward the fixed block 3. This configuration of the compressor allows the refrigerant to cool the stator 7*a*. The refrigerant stirred in the motor chamber 17 to cool the stator 7*a* then flows into the suction passage 3*c* (see the dashed arrow in FIG. 1). Even when the compressor has such a configuration in which the refrigerant is drawn into the suction passage 3*c* and therefore the compression chamber 49 through the first to fifth introduction passages 77*a*-77*e*, i.e., the rotor 7*b*, the refrigerant stirred by the balance weight 33 enables cooling of the stator 7*a*.

Accordingly, the compressor according to the embodiment is allowed to be compact and to have excellent durability.

Particularly, in this compressor, the balance weight 33 extends in the radial direction of the drive shaft 5 to a position where the balance weight 33 covers, from the drive shaft 5 side, a part of the rear coil end 73 in the radial and axial directions of the drive shaft 5 in a view in the axial direction of the drive shaft 5. In this compressor, the coil end 73 of the stator 7*a* is likely to generate heat while the compressor is in operation, but the balance weight 33 stirs the refrigerant that has flowed through the first to fifth introduction passages 77*a*-77*e* while guiding the refrigerant toward the coil end 73. The middle portion 33*b* of the balance weight 33 having the front surface 330 is gradually inclined rearward as the middle portion 33*b* extends from the proximal portion 33*a* in the radial direction of the drive shaft 5. That is, the front surface 330 extends gradually away from the rotor 7*b* in the axial direction of the drive shaft 5 as the front surface 330 approaches the rear coil end 73 in the radial direction of the drive shaft 5. This allows the balance weight 33 of this compressor to suitably guide the refrigerant, which has flowed through the first to fifth introduction passages 77*a*-77*e*, toward the coil end 73. In this compressor, the refrigerant that has flowed through the first to fifth introduction passages 77*a*-77*e* therefore suitably cools the stator 7*a* including the coil end 73.

The balance weight 33 extends in the radial direction of the drive shaft 5 to a position where the balance weight 33 covers, from the drive shaft 5 side, a part of the coil end 73 in the radial direction of the drive shaft 5 in a view in the axial direction of the drive shaft 5, which allows the balance weight 33 to generate centrifugal force at a position sufficiently away from the axis O while the compressor is in operation. This configuration of the compressor allows an increase in the centrifugal force generated by the balance weight 33 while allowing reduction of the thickness of the balance weight 33 for weight reduction.

Further, since the balance weight 33 covers a part of the coil end 73 also in the axial direction of the drive shaft 5, the compressor according to the embodiment allows the balance weight 33 to be located as close to the rear coil end 73 in the axial direction of the drive shaft 5 as possible while placing the balance weight 33 between the fixed block 3 and the motor 7 and securing the space 81 between the balance weight 33 and the rotor 7*b*. This configuration prevents an increase in size of the compressor in the axial direction, thereby allowing the compressor to be compact.

Further, in this compressor, the suction passage 3*c* formed in the fixed block 3 is located outward of the balance weight 33 in the radial direction of the drive shaft 5. This configuration allows the refrigerant, which has been stirred by the balance weight 33 and has flowed toward the outside of the stator 7*a* and therefore the motor 7, to flow into the suction passage 3*c* suitably. Therefore, this compressor is unlikely to cause a pressure drop in the refrigerant while the refrigerant flows from the motor chamber 17 to the suction passage 3*c*. As a result, the refrigerant drawn into the compression chamber 49 is unlikely to cause the pressure drop, which allows the compressor to enhance its operating efficiency.

Although the present disclosure has been described based on the above embodiment, the present disclosure is not limited to the above embodiment, and may be modified within the scope of the present disclosure.

For example, in the compressor according to the embodiment, the balance weight 33 is formed integrally with the drive shaft 5. However, it is not limited to this configuration, and the balance weight 33 may be formed separately from the drive shaft 5, and may be fixed to the large-diameter portion 5*b* of the drive shaft 5 by press fitting or with a screw so that the balance weight 33 is disposed on the drive shaft 5.

Further, in the compressor according to the embodiment, the balance weight 33 has a plate-like and fan-like shape. However, it is not limited to this configuration, and the shape of the balance weight 33, including the shapes of the proximal portion 33*a*, the middle portion 33*b*, and the distal portion 33*c*, may be determined as necessary depending on the magnitude of the centrifugal force generated by the orbital motion of the movable scroll 11.

In the compressor according to the embodiment, the balance weight 33 extends to the rear coil end 73 of the stator 7*a* in the radial direction of the drive shaft 5. However, it is not limited to this configuration, and the balance weight 33 just needs to extend to a position where the balance weight 33 covers at least a part of the fifth introduction passage 77*e* in the radial direction of the drive shaft 5 in a view in the axial direction of the drive shaft 5.

In the compressor according to the embodiment, the middle portion 33*b* of the balance weight 33 has a shape that is gradually inclined rearward as the middle portion 33*b* extends from the proximal portion 33*a* in the radial direction of the drive shaft 5. However, it is not limited to this configuration, and the middle portion 33*b* may have a shape that extends perpendicular to the radial direction of the drive shaft 5 from the proximal portion 33*a*, and only the front surface 330 of the middle portion 33*b* may be gradually inclined rearward while extending in the radial direction of the drive shaft 5.

Further, in the compressor according to the embodiment, the balance weight 33 may include a guiding part, such as a fin or a groove, which guides the refrigerant toward the rear coil end 73.

The compressor according to the embodiment may have a configuration from which the second and third introduction passages 77*b*, 77*c* are omitted and in which the first, fourth, and fifth introduction passages 77*a*, 77*d*, 77*e* are formed integrally with each other to form a single introduction passage.

In the compressor according to the embodiment, the suction passage 3*c* is formed in the fixed block 3, but it is not limited to this configuration, and the suction passage 3*c* may be formed in the motor housing 13 or the like. Alternatively, the compressor according to the embodiment may have a configuration in which the fixed block 3 is fitted with an inner peripheral surface of the motor housing 13 with a partial clearance between the fixed block 3 and the inner peripheral surface of the motor housing 13 so that the clearance serves as the suction passage 3*c*. That is, the suction passage 3*c* may be formed between the motor housing 13 and the fixed block 3.

The present disclosure may be applicable to an air conditioning device for a vehicle and the like.

What is claimed is:

1. An electric compressor comprising:

a housing;

a drive shaft that is disposed in the housing and rotatable around an axis of the drive shaft;

a motor disposed in the housing and configured to rotate the drive shaft;

a fixed scroll fixed to and disposed in the housing;

a movable scroll disposed in the housing and connected to the drive shaft, the movable scroll being revolved by rotation of the drive shaft, wherein a compression chamber that compresses refrigerant is formed between the movable scroll and the fixed scroll; and a fixed block fixed to the housing and disposed between the motor and the movable scroll, the fixed block supporting the drive shaft such that the drive shaft is rotatable, the fixed block defining a motor chamber in the housing to accommodate the motor, wherein the housing has an inlet through which refrigerant is drawn into the motor chamber, the motor includes a stator fixed in the motor chamber and a rotor fixed to the drive shaft, disposed in the stator, and rotatable together with the drive shaft, the stator includes a stator core that has a cylindrical shape and a coil end that has a ring shape and extends from an end face of the stator core in an axial direction of the drive shaft, wherein the coil end has an inner peripheral surface that faces the drive shaft, and a linearly inclined part of the inner peripheral surface that extends in the radial direction of the drive shaft as the inner peripheral surface approaches the fixed block, the rotor has a plurality of introduction passages that is formed through the rotor in the axial direction of the drive shaft, wherein refrigerant flows through the introduction passages, the drive shaft includes a balance weight that is disposed between the fixed block and the motor, the balance weight has a middle portion, a proximal portion directly connected to a first end of the middle portion, and a distal portion directly connected to a second end of the middle portion, the proximal portion of the balance weight faces only one of the introduction passages in a view in the axial direction of the drive shaft, and the proximal portion is disposed between two of the introduction passages in the view in the axial direction of the drive shaft, the balance weight faces a bearing that is located adjacent to a compression part and by which the drive shaft is supported in the axial direction and the radial direction, the balance weight extends to a position where the balance weight covers a part of the coil end in the radial direction and the axial direction of the drive shaft, wherein the middle portion has an inclined surface that extends linearly and continuously from the first end to the second end, wherein the inclined surface inclines as it extends gradually away from the rotor in the axial direction of the drive shaft and approaches the coil end in the radial direction of the drive shaft, wherein the inclined surface of the balance weight faces the linearly inclined part of the inner peripheral surface of the coil end, and the proximal portion extends straight from the drive shaft to the first end of the middle portion in the radial direction of the drive shaft, wherein the balance weight is located away from the rotor by a predetermined distance in the axial direction of the drive shaft so that refrigerant flows from the one of the introduction passages and is guided toward the coil end by the balance weight.

2. The electric compressor according to claim 1, wherein a suction passage is formed in the housing or the fixed block, or formed between the housing and the fixed block, wherein the refrigerant flows from the motor chamber to the compression chamber through the suction passage, and the suction passage is located outward of the balance weight in the radial direction of the drive shaft.

* * * * *